US005820929A

United States Patent [19]

Chi

[11] Patent Number: 5,820,929

[45] Date of Patent: Oct. 13, 1998

[54] METHOD OF PRINTING PATTERNS ON POWDER COATED SURFACE

[75] Inventor: Chung-Shan Chi, Taichung, Taiwan

[73] Assignee: Karen Umbrella Industry Ltd. Co., Taipei, Taiwan

[21] Appl. No.: 529,954

[22] Filed: Sep. 18, 1995

[51] Int. Cl.[6] ..... B05D 1/00; B05D 1/36

[52] U.S. Cl. ..... 427/195; 427/202; 427/203; 427/374.4

[58] Field of Search ..... 427/195, 197, 427/150, 374.4, 146, 149, 148, 202, 203; 101/492; 8/470

[56] References Cited

U.S. PATENT DOCUMENTS 4,767,420 8/1988 Mehl et al. ..... 8/470
5,133,819 7/1992 Croner ..... 156/230

FOREIGN PATENT DOCUMENTS 2159767 12/1985 United Kingdom ..... 427/197

*Primary Examiner*—Shrive Beck
*Assistant Examiner*—Fred J. Parker
*Attorney, Agent, or Firm*—Raymond Sun

[57] ABSTRACT

A method of printing colorful patterns on a powder-coated surface of an article comprises the following steps. The surface of a frame is coated with a powder-coated layer by powder coating method. The frame is enwrapped by the stencil paper. The stencil paper is made by mimeographing method with printing colors and patterns on the stencil paper. The enwrapped frame is heated at about 120° C. to 180° C. for about 30 seconds to 5 minutes. Thus the colors and patterns on the stencil paper will melt and penetrate the powder-coated surface of the frame. The enwrapped frame is cooled. After the enwrapped frame is completely cool, the stencil paper is stripped from the frame. The colors and patterns on the stencil paper is transferred to the powder-coated surface of the frame.

12 Claims, 1 Drawing Sheet

METHOD OF PRINTING PATTERNS ON POWDER COATED SURFACE

BACKGROUND OF THE INVENTION

The invention relates to a method of printing patterns on powder-coated surface. More particularly, the invention relates to a method of transferring printing patterns on a surface of an article after the article is powder-coated.

There are many types of powder coating method. One kind of powder coating applies high electrostatic voltage on the powders which are applied on the surface of an article. The high electrostatic voltage is applied on the nozzle of a spray gun to ionize the air so that the powders will have negative charges while they are sprayed. The charged powders will be adhered and adsorbed on the surface of the article to form a coating layer. The article is baked in order to produce a homogeneous coating layer. The powder is made of non-solvent polymers such as teflon, polyamide and polyimide. However, only a monochromatic color is suitable for the powder coating. If the user wants to apply patterns on the article, the powder coating method is useless. The user has to apply sprayed varnish or adhere patterns on the article directly. Both methods must overlap different colors or patterns so that the colors or patterns will be faded or stripped easily.

SUMMARY OF THE INVENTION

An object of the invention is to provide a method of printing patterns on a powder-coated surface in order to print patterns on the powder-coated article directly.

Another object of the invention is to provide a method of printing colorful patterns on a powder-coated surface in order to obtain colorfast patterns on the powder-coated surface.

Accordingly, a method of printing colorful patterns on a powder-coated surface of an article comprises the following steps. The surface of a frame is coated with a powder-coated layer by a powder coating method. The frame is enwrapped by the stencil paper. The stencil paper is made by mimeographing method with printing colorful patterns on the stencil paper. The enwrapped frame is heated at about 120° C. to 180° C. for about 30 seconds to 5 minutes. Thus the colorful patterns on the stencil paper will melt and penetrate the powder-coated surface of the frame. The enwrapped frame is cooled. After the enwrapped frame is completely cool, the stencil paper is stripped from the frame. The colorful patterns on the stencil paper is transferred to the powder-coated surface of the frame.

DETAILED DESCRIPTION OF THE INVENTION

Figure 1:
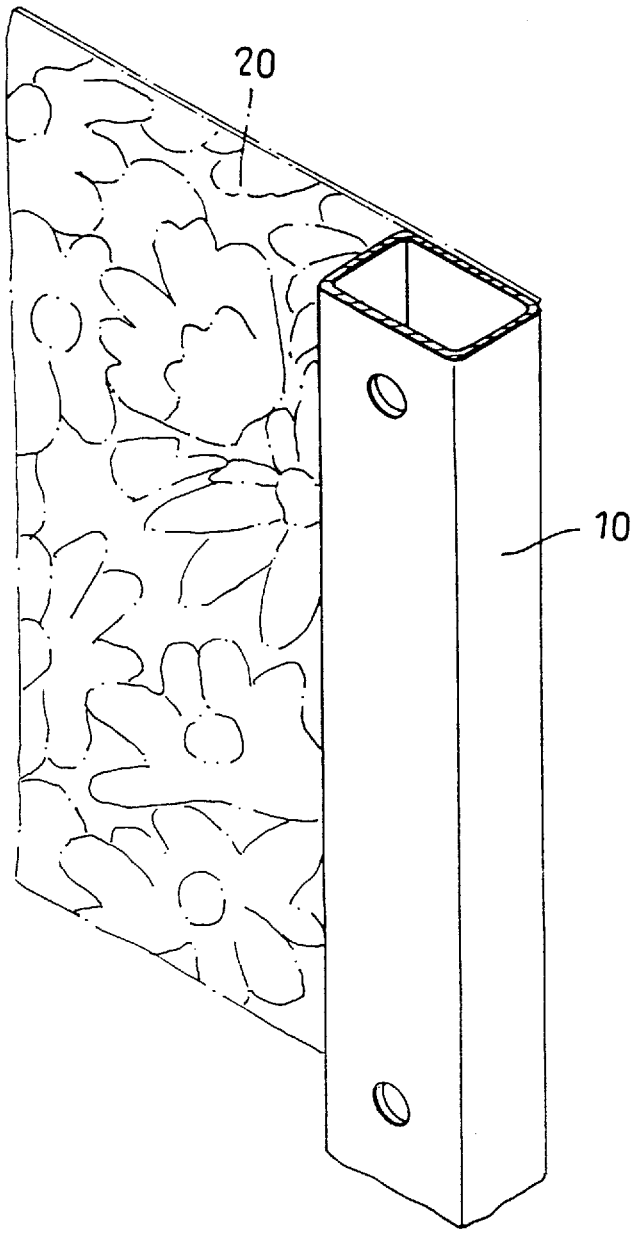
FIG. 1 is a perspective view illustrating a stencil paper before enwrapping a powder-coated frame.

Referring to FIG. 1, a stencil paper 20 (mimeograph paper or oil paper containing inks and patterns) is ready to enwrap a frame 10. The frame 10 has a powder-coated surface. The stencil paper 20 is made by mimeographing method with printing colors and patterns on the stencil paper 20.

The method of the invention comprises the following steps:

Step 1 is to coat a powder-coated layer on the surface of the frame 10 by powder coating method.

Step 2 is to enwrap the frame 10 with the stencil paper 20. The stencil paper 20 is made by mimeographing method with printing colors and patterns on the stencil paper 20.

Step 3 is to heat the enwrapped frame 10 at about 120°C. to 180°C., preferably 140°C. to 160°C. for about 30 seconds to 5 minutes, preferably 1 minute to 3 minutes. The enwrapped frame 10 can be disposed in a heating container such as an oven and a thermostatic heater. Thus the colors and patterns on the stencil paper 20 will melt and penetrate the powder-coated surface of the frame 10.

Step 4 is to cool the enwrapped frame 10. After the enwrapped frame 10 is completely cool, the stencil paper 20 is stripped from the frame 10. The colors and patterns on the stencil paper 20 is transferred to the powder-coated surface of the frame 10. The colors and patterns will not be stripped from the frame 10.

The preferred embodiment of the invention applies the above-mentioned method to transfer colorful patterns from the stencil paper to the powder-coated surface of an article. The colorful patterns will be adsorbed and penetrated into the powder-coated surface of the article by heating. The smooth of the powder-coated surface is maintained after the colorful patterns are transferred. The colors will not be faded.

In the invention, the article is not limited to the frame. As long as the article is not melted nor damaged at 120°C. to 180°C., the article can be applied in the present invention.

Another preferred embodiment has an additional step. After coating the powder-coated layer on the article and before enwrapping the article with the stencil paper, a viscoid adhesive material is used. The surface of the article is coated with the viscoid adhesive material, and then the article is enwrapped by the stencil paper. The viscosity of the viscoid adhesive material should be weak enough so that the stencil paper can be stripped from the article after the enwrapped article is heated and cooled. Thus the adhesive material is selected from a group consisting of size, glue, paste, mastic, mucilage, and polysaccharide. The polysaccharide is selected from a group consisting of dextran, dextrin, starch, and cyclodextrin.

The invention is not limited to the above embodiment but various modification thereof may be made. It will be understood by those skilled in the art that various changes in form and detail may be made without departing from the spirit and scope of the invention.

I claim:

1. A method of printing a pattern onto a surface of a substantially rigid article, comprising the following steps:

a. applying a powder-coat layer on the surface of the article;

b. wrapping the powder-coated surface of the article with a paper having a pattern mimeographed thereon to formed a wrapped surface;

c. heating the wrapped surface of the article so that said pattern penetrates into the powder-coat layer;

d. cooling the wrapped surface; and e. stripping the paper from the surface of the article in which the pattern is transferred to the powder-coated surface of the article.

2. The method of claim 1, wherein the wrapped surface of the article is heated at a temperature of about 120 degrees Celcius to 180 degrees Celcius.

3. The method of claim 2, wherein the wrapped surface of the article is heated for a period of about 30 seconds to 5 minutes.

4. The method of claim 2, wherein the temperature is about 140 degrees Celcius to 160 degrees Celcius.

5. The method of claim 3, wherein the period is about 1 minute to 3 minutes.

6. A method of printing a pattern onto a surface of a substantially rigid article, comprising the following steps:

a. applying a powder-coat layer on the surface of the article;

b. applying an adhesive material on the powder-coated surface of the article to formed a wrapped surface;

c. wrapping the adhesive powder-coated surface of the article with a paper having a pattern mimeographed thereon so that said pattern penetrates into the powder-coat layer;

d. heating the wrapped surface of the article;

e. cooling the wrapped surface; and f. stripping the paper from the surface of the article in which the pattern is transferred to the powder-coated surface of the article.

7. The method of claim 6, wherein the wrapped surface of the article is heated at a temperature of about 120 degrees Celcius to 180 degrees Celcius.

8. The method of claim 7, wherein the wrapped surface of the article is heated for a period of about 30 seconds to 5 minutes.

9. The method of claim 7, wherein the temperature is about 140 degrees Celcius to 160 degrees Celcius.

10. The method of claim 8, wherein the period is about 1 minute to 3 minutes.

11. The method of claim 6, wherein the adhesive is selected from a group consisting of size, glue, paste, mastic, mucilage and polysaccharide.

12. The method of claim 11, wherein the polysaccharide is selected from a group consisting of dextran, dextrin, starch, and cyclodestrin.

* * * * *